US005147993A

United States Patent [19]

Braun et al.

[11] Patent Number: 5,147,993

[45] Date of Patent: Sep. 15, 1992

[54] ELECTRIC RANGE HAVING A MICROWAVE TRAP

[75] Inventors: Walter Braun; Günter Bopp, both of Schorndorf; Dieter Grimm, Pluderhausen, all of Fed. Rep. of Germany

[73] Assignee: Whirlpool International B.V., Eindhoven, Netherlands

[21] Appl. No.: 587,313

[22] Filed: Sep. 21, 1990

[30] Foreign Application Priority Data

Sep. 23, 1989 [DE] Fed. Rep. of Germany ..... 3931859

[51] Int. Cl.[5] ..... H05B 6/76

[52] U.S. Cl. ..... 219/10.55 B; 219/10.55 D

[58] Field of Search ..... 219/10.55 D, 10.55 B, 219/10.55 R, 10.55 E; 174/35 R

[56] References Cited

U.S. PATENT DOCUMENTS 3,878,350 4/1975 Takagi et al. ..... 219/10.55 E
4,096,369 6/1978 Tanaka et al. ..... 219/10.55 D
4,477,706 10/1984 Mittelsteadt ..... 219/10.55 B
4,728,763 3/1988 Bell et al. ..... 219/10.55 B
4,761,529 8/1988 Tsisios ..... 219/10.55 D
4,771,154 9/1988 Bell et al. ..... 219/10.55 B

*Primary Examiner*—Philip H. Leung
*Attorney, Agent, or Firm*—Thomas J. Roth; Stephen D. Krefman; Thomas E. Turcotte

[57] ABSTRACT

For an electric range featuring combined heating by microwave energy, and/or thermal energy a compact and space-saving construction impervious to microwave energy is provided by the thermal-energy source being arranged in a hood which is impervious to microwaves and which is formed at the top of the cooking space. A reflector associated with the thermal-energy source and situated in the transition area between the heating space and the cooking space is connected to a metal grid in an electrically conductive manner and is connected to but insulated from the housing.

18 Claims, 3 Drawing Sheets

ELECTRIC RANGE HAVING A MICROWAVE TRAP

The present invention relates to an electric range having a cooking space for cooking food by applying thermal and/or microwave energy, the thermal-energy source being arranged for example in an upper part of the cooking space and provided with a reflector while being separated from the cooking space by a metal grid having an electrically conductive connection with the reflector.

An electrical appliance of the type described in the foregoing paragraph is also referred to as a combination range. The thermal-energy sources are preferably radiant heaters, for example halogen lamps, which are arranged for example in the upper part of the cooking space and which are generally separated from this space by a glass plate. The glass plate is highly transparent to thermal radiation. The microwave energy which propagates in the cooking space is applied in another part of the range. A reflector arranged above each thermal-energy source ensures a uniform distribution of the thermal radiation. If the thermal-energy source is a halogen lamp which is arranged in a microwave field without any precautions, this will give rise to gas-discharge effects between the filament and its mounting strips. This leads to a reduced efficiency, to undesirable optical effects (blue glow), and to a shorter lamp life. These effects can be mitigated largely in particular by a metal grid which is conductively connected to the reflector. Such a grid, for example an expanded-metal grid, does not affect the distribution of the thermal radiation and provides a substantial reflection of the microwave energy issuing from the cooking space. Such a metal grid has a high electrical conductivity in order to enable the currents to be transmitted with minimal losses. The grid also ensures that the electric field lines are oriented perpendicularly to the grid, which reduces the microwave absorption of the glass plate. Although such a grid reflects the bulk of the microwave radiation, there is always some residual radiation which reaches the space in which the heat source is arranged (heating space), where it produces the undesirable effects in attenuated form.

An electric range of the general type described in the opening paragraph is disclosed known from, for example, U.S. Pat. No. 4,096,369. In the prior-art construction the thermal-energy source is situated in the upper part of the cooking space, which is isolated from the lower part of this cooking space in which the microwave energy propagates. A reflector arranged above the thermal-energy source serves to prevent leakage of microwave radiation along the supply leads to the thermal-energy source. The supply lines to the thermal-energy source are led out via a feed-through means in the housing.

SUMMARY OF THE INVENTION

It is an object of the invention to provide a combination range of the described type defined in the paragraph so as to obtain a compact construction with a proper isolation between the cooking space and the space accommodating the thermal-energy source (heating space) and so as to minimize the microwave radiation emanating from the cooking space into the heating space or to render it harmless.

According to the present invention, this object is achieved by the upper part of the cooking space is constituted by a hood formed on the housing, the reflector, which is arranged in the hood in such a way that a gap is formed relative to the hood, is connected to the flat grid, at the location where the hood makes contact, via a flat peripheral portion, and the reflector is secured to the housing in an insulated manner in such a way that a capacitive microwave trap is formed between the housing and the flat peripheral portion. This results in a compact construction of the range, the actual cooking space being isolated from the heating space, with the thermal-energy source accommodated in the hood, by the grid. The connection between the reflector, which reflector is connected to the grid, and the housing is made in the boundary plane between the cooking space and the heating space in such a way that a capacitive microwave trap is formed between the reflector and the housing, because the reflector is insulated from the housing at the location where it makes contact, preferably by an enamel layer provided on the sheet-metal housing. In this way an effective microwave shielding is obtained in the area between the cooking space and the heating space by the use of simple means. This shielding and the high impedance of the gap formed between the rear of the reflector and the housing prevent the occurrence of large wall currents.

In an illustrative embodiment of the invention, the reflector is secured to the grid of flat construction by flanging the peripheral portion of the reflector. Moreover, at the top in the mounting area of the hood the housing is provided with a raised surround to receive the flat peripheral portion of the reflector with the grid.

Preferably, the reflector can be mounted simply and reliably in that the flat peripheral portions of the reflector with the grid are urged against the steplike raised surround of the housing via a ceramic stud which engages against the inner side of the reflector and which is resiliently supported on the outer side of the hood. This ceramic element can withstand high temperatures and high electric field strengths.

Any residual radiation penetrating the heating space via the grid results in the microwaves propagating along the thermal-energy source, for example a spiral filament. Propagation along a spiral element of the thermal-energy source can be prevented in that, in an embodiment of the invention, said spiral filament has a high impedance for the residual radiation penetrating through the grid. However, the non-spiralled leads to the filament act as antennas and enable a coaxial TEM-wave to be formed. This gives rise to luminous phenomena and to a comparatively high amount of microwave leakage through the feed-through means for the thermal-energy source which are arranged in the walls of the hood. In a further embodiment of the invention these drawbacks can be mitigated in that at its exterior at the location of a feed-through means of the thermal-energy source the housing comprises an angular shielding plate which is electrically insulated from the housing and which has one limb, extending perpendicularly to the supply lead of the thermal-energy source and having an electrically conductive connection with said lead, and which has another limb, extending parallel to the supply lead and secured to the upper side of the housing. The limb of the shielding plate, which limb is disposed perpendicularly to the supply lead, short-circuits the coaxial TEM-wave and gives rise to a mismatch or reflection of microwave energy. The other horizontal limb of the shielding plate provides additional microwave shielding.

In a further embodiment of the invention the vertical limb of the shielding plate is insulated from the enamelled housing by means of a U-shaped insulator and the horizontal limb by means of an insulating foil. The housing and the shielding plate now constitute a capacitor of low capacitance. This capacitor isolates the applied mains voltage from the housing and short-circuits high-frequency electric potentials. This precludes static charges which could give rise to luminous effects at the location of the lamp feed-through means.

The above-mentioned comparatively high amount of leakage radiation at the location of the feed-through means is caused by the fact that the feed-through means and the supply lead constitute a coaxial line for the microwave, in which line a wave propagates. The portion of the shielding plate which extends perpendicularly to the supply lead in the proximity of this feed-through and which is conductively connected to the supply lead constitutes a low-impedance termination for the coaxial line, i.e. the wave is short-circuited. As a result of such a mismatch the coaxial wave is reflected back into the housing. Preferably, this is achieved in that the limb of the shielding plate which extends perpendicularly to the supply lead has a dimension which is at least equal to a quarter of the wavelength of the microwave in free space.

BRIEF DESCRIPTION OF THE DRAWING

In the drawing

FIG. 1 is a plan view, partly sectional view, showing a part of an electric range.

FIG. 2 is a sectional view taken on the line II—II in FIG. 1,

FIG. 3 is a cross-sectional view, to a different scale, taken on the line III—III in FIG. 2, and FIG. 4 depicts a detail.

DETAILED DESCRIPTION OF THE PREFERRED EMBODIMENT

Figure 1:
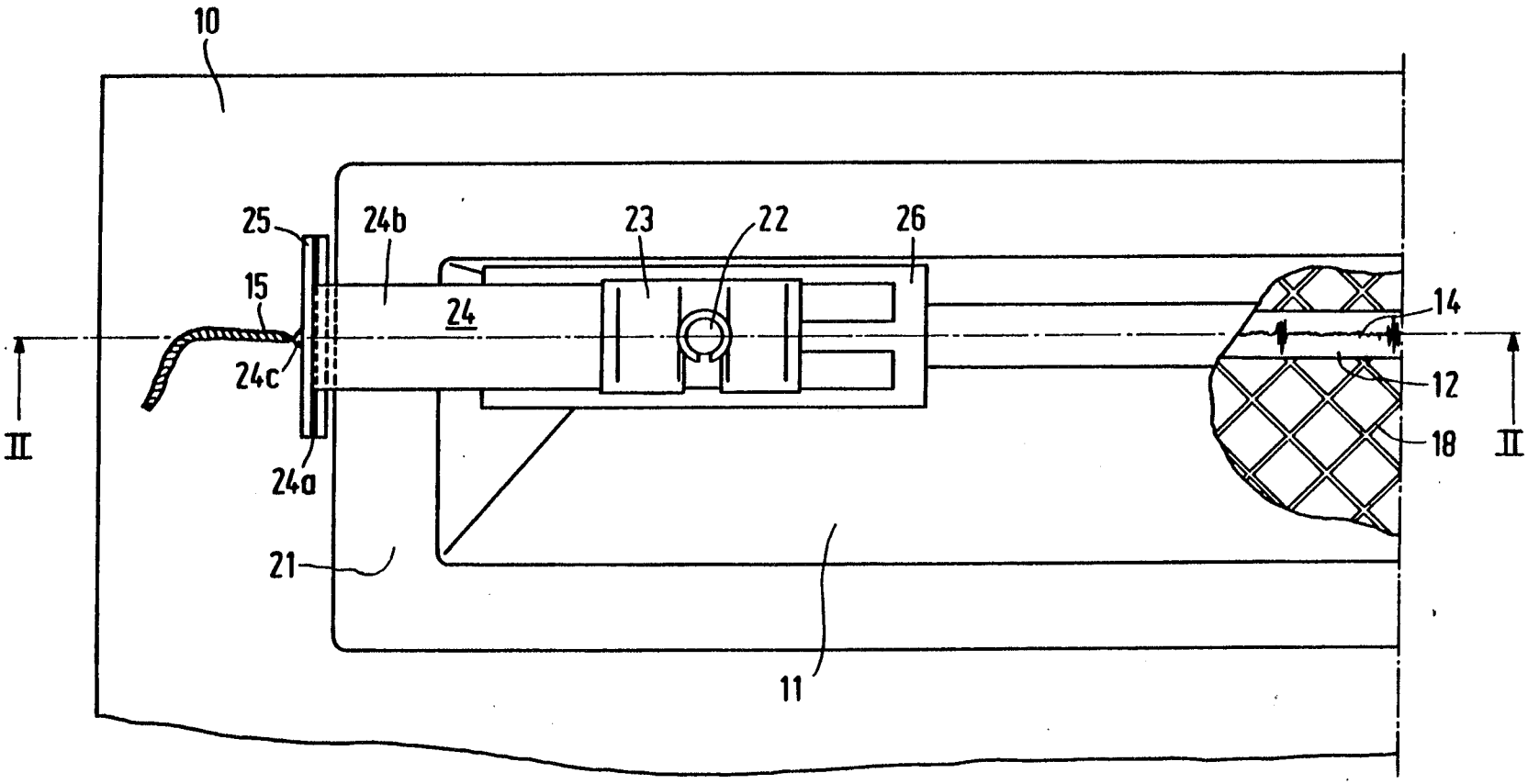
FIGS. 1 to 4 show diagrammatically an exemplary embodiment of the invention.
Figure 2:
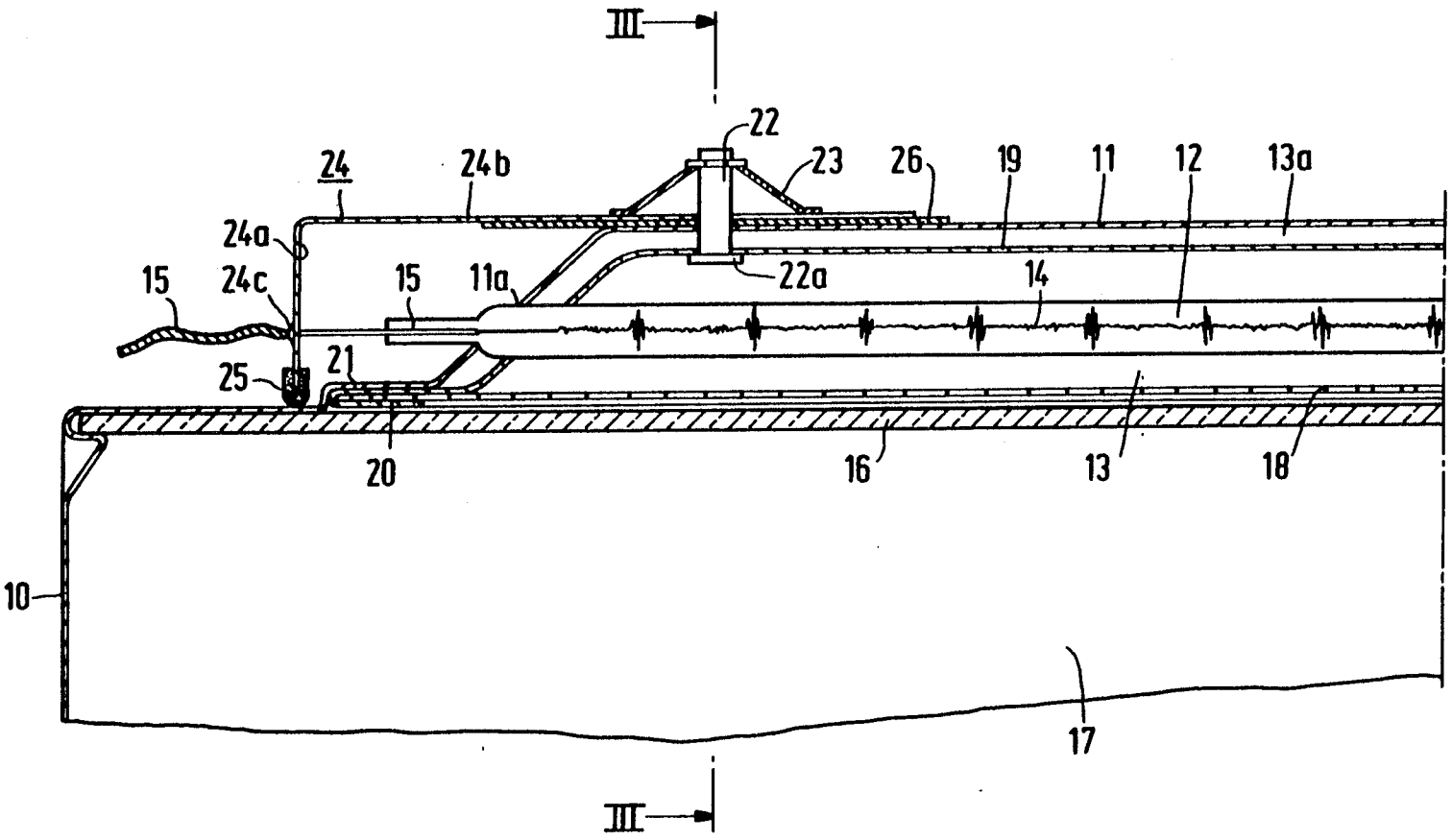
Figure 3:
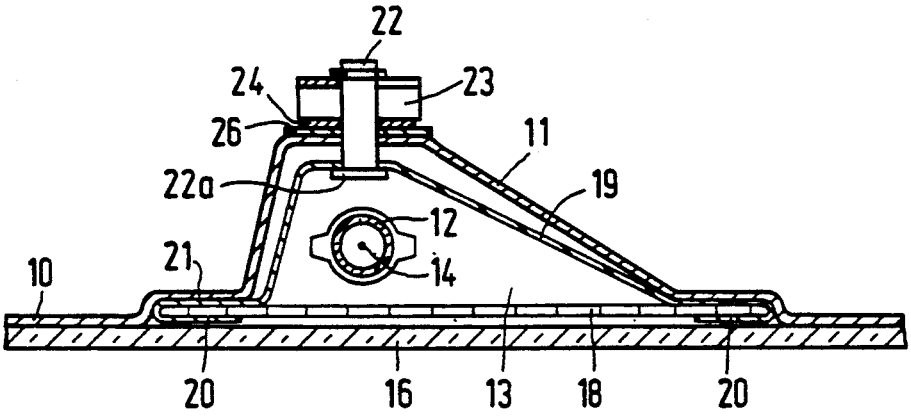

The electric range in accordance with the invention comprises a sheet-iron housing 10 which is enamelled at both sides and which at its top comprises a hood 11 formed in the upper housing wall to accommodate and support a halogen lamp 12 in a heating space 13. The halogen lamp 12 has a spiral filament 14 and non-spiralled supply leads 15 and is supported in feed-through means 11*a* of the hood 11. The heating space 13 with the halogen lamp 12 is separated from the cooking space 17 of the electric range by a glass plate 16. An expanded-metal grid 18 extends in the boundary plane between the cooking space 17 and the heating space 13 and is connected to a reflector 19 in an electrically conductive manner by flanged flat peripheral portions 20. The flat peripheral portions 20 of the reflector are situated in a steplike raised surround 21 at the top of the housing 10. The unit comprising the reflector 19 and the grid 18 is mounted via a ceramic sleeve 22 which engages against the inner side of the reflector 19 with a collar 22*a* at one end of which is supported on the outer side of the hood 20 at its other end via a spring 23. Thus, the flat peripheral portions 20 are urged against the surround 21 under spring pressure. In combination with the high impedance of the gap 13*a* between the rear of the reflector 19 and the wall of the hood 11 the flat peripheral portions 20 together with the enamelled wall portions of the surround 21 constitute a capacitive microwave trap to prevent large wall currents.

The non-spiralled supply leads 15 of the halogen lamp 12 act as antennas for the residual radiation penetrating through the grid 19 and may give rise to a coaxial TEM-wave along the supply lead 15. This may lead to static charges in the lamp, which give rise to luminous effects at the location of the lamp feed-through means 11*a*. This is precluded by means of an angular shielding plate 24 comprising a limb 24*a* perpendicular to the supply lead and a limb 24*b* parallel to the supply lead. The limb 24*a* has an electrically conductive connection with the supply lead 15. By means of an U-shaped insulator 25 the limb 24*a* and by means of an insulating disc 26, the limb 24*b* is insulated from the housing 10 and the hood 11 respectively. The hood 11 and the limb 24*b* constitute a capacitor of low capacitance to isolate the applied electrical supply voltage from the housing and to short-circuit high-frequency electric potentials.

The limb 24*a*, which extends perpendicularly to the supply lead 15, thus reflects microwaves emerging as coaxial waves into the hood 11, while the limb 24*b* which extends parallel to the supply lead enables radiation leakage to be further reduced through its shielding action.

Figure 4:
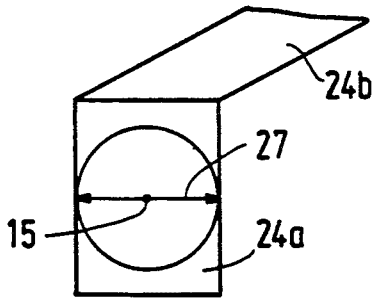

FIG. 4 shows the angular shielding plate 24, whose limb width is indicated by reference numeral 27.

We claim:

1. An electric range having a cooking space for cooking food by applying thermal and/or microwave energy, a thermal-energy source being arranged in an upper part of a cooking space (17) defined by a housing (10), the thermal-energy source being provided with a reflector and being separated from the cooking space by a metal grid having an electrically conductive connection with the reflector, the electric range comprising a hood (11) formed on the housing (10), the reflector (19) arranged in the hood (11) to form a gap (13*a*) relative to the hood (11) and being connected to the flat metal grid (18), via a flat peripheral portion (20), and the reflector (19) being secured to the housing (10, 21) in an insulated manner to form a capacitive microwave trap between the housing (10, 21) and the flat peripheral portion (20).

2. An electric range as claimed in claim 1, wherein the housing (10) is externally and internally provided with an insulating layer comprising an enamel layer.

3. An electric range as claimed in claim 2, wherein the flat peripheral portion (20) of the reflector with the grid is urged against a raised surround (21) of the housing (10) via a ceramic stud (22) which engages against the reflector (19) and which is resiliently supported on the hood (11).

4. An electric range as claimed in claim 2, wherein the housing (10, 11) comprises an angular shielding plate (24) which is electrically insulated from the housing (10, 11) and which has one member (24*a*), extending perpendicularly to a supply lead (15) of the thermal-energy source (12) and having an electrically conductive connection (24*c*) with said supply lead (15), and has another member (24*b*) extending parallel to the supply lead (15) and secured to the housing (11).

5. An electric range as claimed in claim 2, wherein the termal-energy source (12) is a halogen lamp whose spiral filament (14) has a high impedance to provide mismatching.

6. An electric range as claimed in claim 1 wherein the reflector (19) is secured to the grid (18) by flanging its peripheral portion (20).

7. An electric range as claimed in claim 6, wherein the flat peripheral portion (20) of the reflector with the grid is urged against a raised surround (21) of the housing (10) via a ceramic stud (22) which engages against the reflector (19) and which is resiliently supported on the hood (11).

8. An electric range as claimed in claim 6, wherein the housing (10, 11) comprises an angular shielding plate (24) which is electrically insulated from the housing (10, 11) and which has one member (24*a*), extending perpendicularly to a supply lead (15) of the thermal-energy source (12) and having an electrically conductive connection (24*c*) with said supply lead (15), and has another member (24*b*) extending parallel to the supply lead (15) and secured to the housing (11).

9. An electric range as claimed in claim 1, wherein a raised surround (21) is provided in housing (10) where housing (10) contacts hood (11).

10. An electric range as claimed in claim 9, wherein the flat peripheral portion (20) of the reflector with the grid is urged against the raised surround (21) of the housing (10) via a ceramic stud (22) which engages against the reflector (19) and which is resiliently supported on the hood (11).

11. An electric range as claimed in claim 9, wherein the housing (10, 11) comprises an angular shielding plate (24) which is electrically insulated from the housing (10, 11) and which has one member (24*a*), extending perpendicularly to a supply lead (15) of the thermal-energy source (12) and having an electrically conductive connection (24*c*) with said supply lead (15), and has another member (24*b*) extending parallel to the supply lead (15) and secured to the housing (11).

12. An electric range as claimed in claim 1, wherein the flat peripheral portion (20) of the reflector with the grid are urged against a raised surround (21) of the housing (10) via a ceramic stud (22) which engages against the reflector (19) and which is resiliently supported on the hood (11).

13. An electric range as claimed in claim 12, wherein the housing (10, 11) comprises an angular shielding plate (24) which is electrically insulated from the housing (10, 11) and which has one member (24*a*), extending perpendicularly to a supply lead (15) of the thermal-energy source (12) and having an electrically conductive connection (24*c*) with said supply lead (15), and has another member (24*b*) extending parallel to the supply lead (15) and secured to the housing (11).

14. An electric range as claimed in claim 1, wherein the housing (10, 11) comprises an angular shielding plate (24) which is electrically insulated from the housing (10, 11) and which has one member (24*a*), extending perpendicularly to a supply lead (15) of the thermal-energy source (12) and having an electrically conductive connection (24*c*) with said supply lead (15), and has another member (24*b*) extending parallel to the supply lead (15) and secured to the housing (11).

15. An electric range as claimed in claim 1, wherein a heating space (13), which accommodates the thermal-energy source (12) is separated from the cooking space (17) by a glass plate (16).

16. An electric range as claimed in claim 1, wherein the thermal-energy source (12) is a halogen lamp whose spiral filament (14) has a high impedance to provide mismatching.

17. An electric range as claimed in claim 1, wherein at its end a vertical member (24*a*) is insulated by an insulating foil (24).

18. An electric range as claimed in claim 1, wherein a vertical member (24*a*) extending perpendicularly to a supply lead (15) has a width (27) at least equal to a quarter of a free-space wavelength of the microwave emerging from the hood (11) via the supply lead (15).

* * * * *